US009932710B2

(12) United States Patent
Kuo et al.

(10) Patent No.: US 9,932,710 B2
(45) Date of Patent: Apr. 3, 2018

(54) POROUS METAL MOLD FOR WET PULP MOLDING PROCESS AND METHOD OF USING THE SAME

(71) Applicant: GOLDEN ARROW PRINTING CO., LTD., New Taipei (TW)

(72) Inventors: Chien-Kuan Kuo, New Taipei (TW); Chun-Huang Huang, New Taipei (TW)

(73) Assignee: GOLDEN ARROW PRINTING CO., LTD., New Taipei (TW)

( * ) Notice: Subject to any disclaimer, the term of this patent is extended or adjusted under 35 U.S.C. 154(b) by 38 days.

(21) Appl. No.: 14/965,075

(22) Filed: Dec. 10, 2015

(65) Prior Publication Data

US 2016/0168800 A1 Jun. 16, 2016

Related U.S. Application Data

(60) Provisional application No. 62/091,164, filed on Dec. 12, 2014.

(30) Foreign Application Priority Data

Nov. 6, 2015 (TW) ..... 104136715 A
Nov. 6, 2015 (TW) ..... 104217870 U

(51) Int. Cl.
*D21J 3/00* (2006.01)
*B22F 5/00* (2006.01)
(Continued)

(52) U.S. Cl.
CPC *D21J 3/00* (2013.01); *B22F 3/10* (2013.01); *B22F 3/1146* (2013.01); *B22F 5/007* (2013.01); *C22C 1/08* (2013.01); *B22F 2207/17* (2013.01)

(58) Field of Classification Search
CPC ..... D21J 3/00; D21J 7/00; D21J 3/10; B29C 51/10; B29C 51/28; B29C 51/30;
(Continued)

(56) References Cited

U.S. PATENT DOCUMENTS 2,157,596 A * 5/1939 Davis ..... B01D 39/2034 210/510.1
3,067,470 A * 12/1962 Reifers ..... D21J 7/00 162/411
(Continued)

FOREIGN PATENT DOCUMENTS

EP 0559490 A1 * 9/1993 ..... D21J 7/00
EP 0559491 A1 * 9/1993 ..... D21J 7/00
(Continued)

*Primary Examiner* — Jose A Fortuna
(74) *Attorney, Agent, or Firm* — Osha Liang LLP

(57) ABSTRACT

A porous metal mold for a wet pulp molding process is disclosed herein. The porous metal mold comprises a first surface where a paper-pulp-fiber layer is disposed for forming a finished paper-shape product or a semi-finished paper-shape product; a cavity, formed on the first surface, for shaping the finished paper-shape product or the semi-finished paper-shape product; and a second surface. The porous metal mold is made by integrally sintering a plurality of metal particles, and after the sintering at least one pore is formed between at least two of the metal particles so that at least one through hole between the first surface and the second surface of the porous metal mold, for exhausting water or moisture contained in the paper-pulp-fiber layer disposed on the first surface.

9 Claims, 4 Drawing Sheets

(51) Int. Cl.
*B22F 3/10* (2006.01)
*C22C 1/08* (2006.01)
*B22F 3/11* (2006.01)

(58) Field of Classification Search
CPC ..... B29C 2791/006; B29C 2791/007; B29C 243/006; B29C 43/361; B22F 2207/17; B22F 3/10; B22F 3/11; B22F 3/1146; B22F 5/007; C22C 1/08; Y10T 428/31989
See application file for complete search history.

(56) References Cited

U.S. PATENT DOCUMENTS 3,378,365 A * 4/1968 Schnuchel ..... B01D 39/2044 427/245
5,547,544 A * 8/1996 Miyamoto ..... D21J 7/00 162/199
5,705,118 A * 1/1998 Hayes ..... A61F 2/28 264/414
5,745,971 A * 5/1998 Ohsawa ..... B29C 51/28 264/510
6,365,092 B1 * 4/2002 Backa ..... B01D 53/885 264/628
6,582,562 B2 * 6/2003 Gale ..... D21J 5/00 162/226
2006/0057356 A1 * 3/2006 Yamamura ..... C22C 1/1036 428/312.2
2010/0207300 A1 * 8/2010 Johnson ..... D21J 3/00 264/442
2012/0276400 A1 * 11/2012 Nilsson ..... D21J 3/00 428/537.1
2016/0168793 A1 * 6/2016 Kuo ..... D21J 3/12 162/227
2016/0168800 A1 * 6/2016 Kuo ..... D21J 3/00 162/218
2016/0168801 A1 * 6/2016 Kuo ..... D21J 3/00 162/194
2016/0244917 A1 * 8/2016 Kuo ..... D21J 3/00
2016/0348314 A1 * 12/2016 Kuo ..... D21J 3/00
2016/0362845 A1 * 12/2016 Kuo ..... D21H 21/18

FOREIGN PATENT DOCUMENTS

GB 550058 A * 12/1942 ..... D21J 3/00
WO WO 9835097 A1 * 8/1998 ..... D21J 5/00
WO WO 2006057609 A1 * 6/2006 ..... D21J 3/00

* cited by examiner

POROUS METAL MOLD FOR WET PULP MOLDING PROCESS AND METHOD OF USING THE SAME

CROSS-REFERENCES

This application claims the benefits of U.S. Provisional Patent Application No. 62/091,164 filed on Dec. 12, 2014 and Taiwan Patent Application No. 104136715 filed on Nov. 6, 2015, the contents of which are incorporated herein by reference in their entirety.

BACKGROUND OF THE INVENTION

Field of Invention

The present invention relates to a porous metal mold for a wet pulp molding process and a method of using the same, and more particularly, to a porous metal mold which is made by powder metallurgy and is used for forming a wet paper-shape product/semi-finished product by thermo-compression.

Description of Prior Art

Recently, for environmental protection, paper-shape package material has been widely applied for various products, such as electronic devices or food containers. In a conventional wet pulp paper-shaping process which mainly comprises a dredging step and a compression-forming step, the implementations of the dredging step and compression-forming step must adopt a set of mold assembly (such as an upper mold and a lower mold) so as to form the finished paper-shape products. Conventionally, the mold assembly is applied with traditional aluminum-casted molds and a layer of metal mesh additionally overlapped on forming surfaces of the aluminum-casted molds. In the dredging step, the aluminum-casted molds are used to dredge up the paper fibers from a slurry tank containing a paper slurry, thereby keeping the paper fibers on the metal mesh. In the compression-forming step, a vacuum pump device liquid-communicated with the bottom of the aluminum-casted mold is used to absorb part of water off of the paper fibers on the metal mesh, in order to leave the paper fibers on the metal mesh to form the wet pulp.

However, the metal mesh is usually welded directly onto the forming surfaces of the aluminum-casted molds. During the compression-forming step, the metal mesh is continuously punched by the absorbing air flows and the compression applied between the molds, such that the metal mesh is easily drawn to thorns, cracked, broken, apart from the molds, or even deformed. This results in extremely shorting the life time of the aluminum-casted molds. After repeating the compression-forming step for several times, an artificial repair or a replacement of the metal mesh is necessary. Besides, grids and/or the welding point of the metal mesh are easily branded onto the surface of the wet paper-shape product made by the metal mesh, to form screen printings affecting the appearance and plainness of the products after.

Furthermore, the traditional metal mesh does not only need to manually weave the metal mesh in complication and wasting time to form a simple arc shape, but also limit the shape of other new products. Also, the aluminum-casted molds with the metal mesh need to form a plurality of through holes distributed around the outer surface of the molds, for exhausting the water and moisture contained in the paper fibers above the metal mesh to dry. In order to prevent machining process of forming the through holes on the aluminum-casted molds from being implemented difficult after the formation process of the whole molds, the aluminum-casted molds need to punch the through holes on the outer surfaces of the aluminum-casted molds by a mechanical drilling method, after the aluminum-casted molds has been casted, time and effort is needed. The distance between every two through holes would be limited by the mechanical drilling method so that the density of arranging the through holes is lower, and then by performing a machining process (cutting or milling), the finial-required contour of the aluminum-casted molds is shaped. This would invoke the mold development risk increased. During the operation of cutting or milling, the scraps can very easily choke the through holes, which is difficult to clean manually. Hence, how to create a new mold design and mold-manufacturing art which can lower the manufacturing cost and enhances the economical profit is required for development.

SUMMARY OF THE INVENTION

In order to overcome the drawbacks and shortages of the conventional art, the present invention provides a porous metal mold for a wet pulp molding process, the porous metal mold can not only eliminate mesh-marks to enhance the appearance and the smoothness of the wet paper-shape product/semi-finished product, but can also reduce the manufacture/maintenance time for meshes, reduce human costs, and maintain the excellent heat-conductivity of the conventional aluminum mold.

A porous metal mold for a wet pulp molding process of the present invention comprises: a first surface where a paper-pulp-fiber layer is disposed for forming a finished paper-shape product or a semi-finished paper-shape product; a cavity, formed on the first surface, for shaping the finished paper-shape product or the semi-finished paper-shape product; and a second surface. The porous metal mold is made by integrally sintering a plurality of metal particles, and after the sintering at least one pore is formed between at least two of the metal particles so that at least one through hole between the first surface and the second surface of the porous metal mold, for exhausting water or moisture contained in the paper-pulp-fiber layer disposed on the first surface.

In one embodiment of the present invention, the metal particles are made of stainless steel, nickel-alloy, or copper.

In one embodiment of the present invention, the metal particles are formed in sphere shapes, irregular shapes, multilateral shapes, or other shapes.

In one embodiment of the present invention, a total pore-ratio of the porous metal mold is between 10%-25% of the porous metal mold.

In one embodiment of the present invention, a heat-conduction ratio of the porous metal mold is larger than 50 W/mk.

In one embodiment of the present invention, a mean diameter of the metal particles is in a range of 5-10 μm.

In one embodiment of the present invention, at least one metal particle layer is formed between the first surface and the second surface.

In one embodiment of the present invention, the at least one metal particle layer comprises a plurality of different metal particle layers, the metal particles respectively located in the different metal particle layers have different mean diameters.

In one embodiment of the present invention, the mean diameter of the metal particles in which one of the metal particle layers is close to the first surface is smaller than the mean diameter of the metal particles in which one of the metal particle layers is far away from the first surface.

In order to overcome the drawbacks of the conventional art, one objective of the present invention is to provide a method of manufacturing a porous metal mold for a wet pulp molding process, by integrally sintering a plurality of metal particles to form a porous metal mold, with the tiny through holes formed based on the porous features on the inside and outside surface of the porous metal mold, the conventional mechanical punching operation on outer surfaces of each surface is needless, then, time and effort are saved accordingly.

Another objective of the present invention is to provide a method of manufacturing a porous metal mold for a wet pulp molding process, by integrally sintering a plurality of metal particles to form a porous metal mold, the tiny through holes with a distribution density of through holes is higher than a distribution density of the through holes formed by mechanical punching and mesh are formed based on the porous features on the inside and outside surface of the porous metal mold, so no metal mesh is used as it is in the conventional art. Hence, mesh-marks are eliminated to enhance the appearance and the smoothness of the wet paper-shape product/semi-finished product, and also reduce manufacture/maintenance time for meshes, reduce human costs, and maintain the excellent heat-conductivity of the conventional aluminum mold.

The another objective of the present invention is to provide a manufacturing method of a porous metal mold for a wet pulp molding process, wherein the cutting or milling scraps do not choke the through holes in the mold.

Another objective of the present invention is to provide a method of manufacturing a porous metal mold for a wet pulp molding process, while processing the dredging step and/or the compression-forming step by the porous metal mold formed by the manufacturing method mentioned above, no mechanical punching and metal meshes are required, as in the conventional art, thereby saving manufacturing costs, time and human resources. The tiny through holes with a distribution density of through holes is higher than a distribution density of the through holes formed by mechanical punching and meshes are formed based on the porous features on the inside and outside surface of the porous metal mold. The tiny through holes with a diameter of through holes is less than a diameter of the through holes formed by mechanical punching and mesh are formed based on the porous features on the inside and outside surface of the porous metal mold. So it is not necessary to use mechanical punching on the conventional art and metal mesh, the manufacturing cost, time, and human resource are decreased.

In order to achieve the purpose of the present invention, the present invention provides a method of manufacturing a porous metal mold for a wet pulp molding process, which comprises: (1) preparing the porous metal mold where a plurality of through holes are formed and exposed on at least one outer surface of the porous metal mold, wherein the outer surface comprises a machined region and a non-machined region; (2) forming a solidified-resin layer over the at least one outer surface of the porous metal mold and the exposed through holes, to cover and protect the through holes exposed on the non-machined region; (3) performing a machining process on the machined region on the porous metal mold; (4) removing the solidified-resin layer from the porous metal mold, to expose the through holes; and (5) performing a fine-polishing process on the at least one outer surface of the porous metal mold.

In one embodiment of the present invention, the step (1) further comprises: (1-1) choosing a plurality of metal particles in a specific mean diameter range according to a predetermined sintering pore-ratio; (1-2) filling the metal particles into a sintering mold with a specific shape; (1-3) heating the metal particles filled in the sintering mold to a specific sintering temperature, deriving the porous metal mold with the predetermined sintering pore-ratio.

In one embodiment of the present invention, wherein in the step (1-1), the predetermined sintering pore-ratio is between 10%-25% of the porous metal mold.

In one embodiment of the present invention, wherein in the step (1-1), the specific mean diameter range of the metal particles is in a range of 2-20 μm.

In one embodiment of the present invention, the metal particles are copper, and the specific sintering temperature is between 800-920° C.

In one embodiment of the present invention, the metal particles are stainless steel or nickel alloy, and the specific sintering temperature is between 1000-1350° C.

In one embodiment of the present invention, wherein in the step (1-3), a time of sintering is between 30-60 minutes.

In one embodiment of the present invention, the step (2) further comprises: (2-1) soaking the porous metal mold in a solidifiable resin solution, to cover a resin layer on the at least one outer surface of the porous metal mold; and (2-2) performing a solidifying process to solidify the resin layer, for forming the solidified-resin layer.

In one embodiment of the present invention, wherein in the step (2-1), the solidifiable resin solution is a solution of a thermoplastic resin or a light curable resin, the thermoplastic resin or the light curable resin is selected from at least one or a combination of melamine resin, urea-formaldehyde resin and phenol-formaldehyde resin.

In one embodiment of the present invention, wherein in the step (2-2), the solidifying process is performed by heating or applying a light with a certain wavelength.

In one embodiment of the present invention, wherein in the step (3), the machining process is at least one or a combination of a traditional cutting operation, a milling operation, a laser cutting operation, a computer numeral control (CNC) machining operation, or an electric arc operation.

In one embodiment of the present invention, the step (4) further comprises: heating the solidified-resin layer to make the solidified-resin layer burn out.

In one embodiment of the present invention, a heat-conduction ratio of the porous metal mold is larger than 50 W/mk.

The present invention further provides a wet pulp forming process, using the porous metal mold manufactured by the method as above mentioned embodiments, to perform a dredging step and/or a compression-forming step.

DETAILED DESCRIPTION OF THE PREFERRED EMBODIMENTS

The following description of each embodiment, with reference to the accompanying drawings, is used to exemplify specific embodiments which may be carried out in the present invention. The claims of the present invention are not limited by these embodiments, but are defined by the presented claims.

In a thermo-compression step of the wet pulp forming process according to the present invention, a wet paper-shape finished product or semi-finished product is formed by a set of mold assembly which mainly comprises an upper mold and a lower mold. The upper mold and the lower mold are respectively formed with a plurality of through holes on at least one outer surface of the respective mold. The upper mold and the lower mold are respectively connected with at least one heating equipment for drying the paper fiber of the wet pulp, and connected with a vacuum suctioning device for absorbing the respective mold in vacuum. While the upper mold and the lower mold are matched with each other by performing the thermos-compression step, a thermal energy is conducted to the upper mold and the lower mold via the heating equipment, a portion of the water contained in the paper fiber located between the matched upper and lower molds is heated into vapor. Then, the water or moisture in the paper fiber is absorbed out from the through holes of the upper mold and the lower mold by the vacuum suctioning device, so as to rapidly lower the water content in the paper fiber. While the upper mold and the lower mold are separated from each other, the paper fiber is left on the outer surface of the corresponding mold, and a negative pressure generated inside a shaping space is greatly lower than a compression pressure while matching the molds such that the water can be inhibited from flowing back to the paper fiber.

Figure 1:
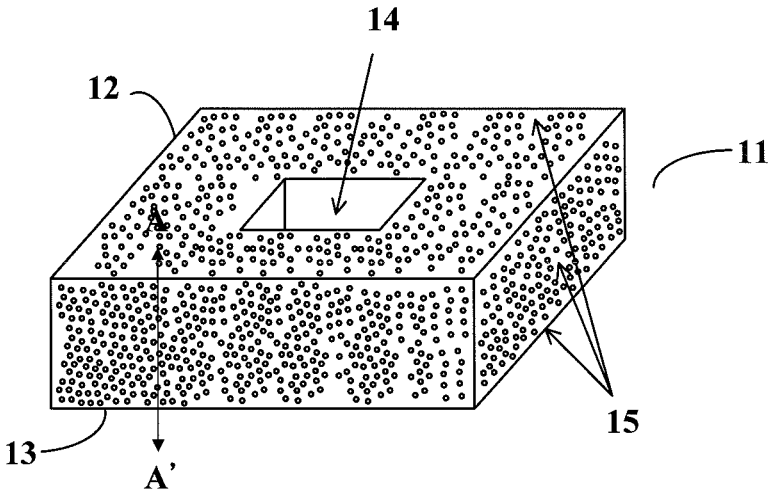
FIG. 1 is stereoscopic illustrative view of a porous metal mold according to a first embodiment of the present invention.
Figure 2:
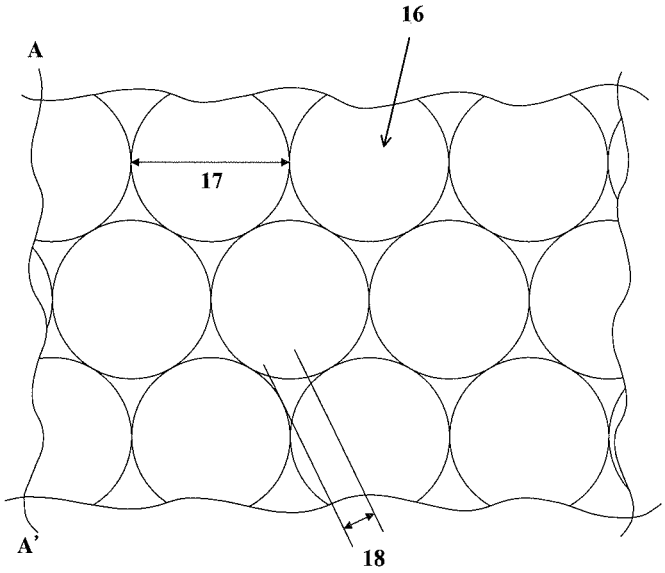
FIG. 2 is a sectional enlarged illustrative view according to a cutting line A-A' shown in FIG. 1.

In order to lower the water content in the paper fiber, according to one preferred embodiment, in the thermo-compression step, the upper mold is made of an aluminum alloy and formed with smoother surfaces, and the lower mold is made of a porous metal material to form a porous metal mold 11 as shown in FIGS. 1 and 2. The porous metal mold 11 has a first surface 12 and a second surface 13. The first surface 12 where a paper-pulp-fiber layer is disposed thereon for forming a finished paper-shape product or a semi-finished paper-shape product. A cavity 14 is formed on the first surface 12, for shaping the finished paper-shape product or the semi-finished paper-shape product. The porous metal mold 11 is made by integrally sintering a plurality of metal particles 16 (see FIG. 2), wherein at least one pore 18 is formed between at least two of the metal particles 16 after the sintering, thereby construing at least one through hole 15 extended through the first surface 12 and the second surface 13 of the porous metal mold 11, for exhausting the water and/or moisture contained in the paper-pulp-fiber layer disposed on the first surface 12 to the outside of the second surface 13. In the present embodiment, the second surface 13 is parallel with the first surface 12; however, in other embodiments, the second surface 13 is perpendicular with the first surface 12.

Besides, the dimensions of the metal particles 16 will affect a pore-ratio of the whole mold 11. If the dimension of the pore 18 between every two of the metal particles 16 is too large, the paper fiber will easily invade inside the lower mold 11 via the through holes 15, causing the paper-shape product surface rough or the through holes 15 choked; otherwise, if the dimension of the pore 18 between every two of the metal particles 16 is too small, the through holes 15 will be too narrow to release the water and/or moisture from the paper fiber. For a mean diameter of a common paper fiber is about 16-45 μm, and the dimension of the pore 18 between every two of the metal particles 16 is naturally less than a mean diameter 17 of the metal particles 16. Therefore, in the present invention, the porous metal mold 11 is made by sintering the metal particles 16 having a mean diameter 17 of about 5-10 μm and has a total pore-ratio of about 10%-25% of the volume of the porous metal mold 11.

Ideally, the material of the metal particles 16 can be copper, which depends upon a heat-conduction ratio. In the preferred embodiment, the heat-conduction ratio of the porous metal mold 11 sintered by the metal particles 16 is larger than 50 W/mk, in order to rapidly conduct the thermal energy to the mold 11, for heating the paper fiber. Hence, the material of the metal particles 16 is not limited to the copper, and can be selected from the stainless steel, nickel-alloy or other material, a heat-conduction ratio of which meets the above requirement.

Figure 3:
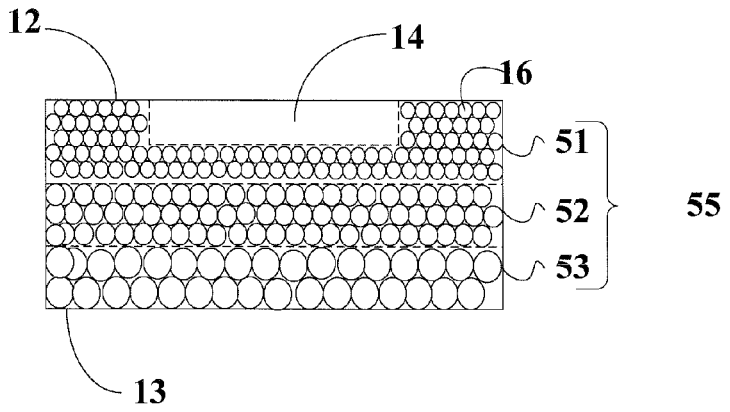
FIG. 3 is lateral view of a porous metal mold according to a second embodiment of the present invention.

Please refer to FIG. 3, which is a lateral side view of a porous metal mold according to a second embodiment of the present invention. The difference between the second embodiment and the first embodiment is that there are a plurality of metal particle layers 55 overlaid vertically between the first surface 12 and the second surface 13. The metal particle layers 55 comprise a first metal particle layer 51, a second metal particle layer 52, and a third metal particle layer 53. Depending upon different demands, the first metal particle layer 51, the second metal particle layer 52, and the third metal particle layer 53 respectively use the metal particles 16 with different mean diameters 17.

Ideally, the first metal particle layer 51 is used to contact with a finished paper-shape product or a semi-finished paper-shape product, so that the metal particles 16 of the first metal particle layer 51 must have a small mean diameter 17 to fine an outer surface of the finished paper-shape product or the semi-finished paper-shape product while shaping. According to FIG. 3, the mean diameter 17 of the metal particles 16 of the first metal particle layer 51 close to the first surface 12 is smaller than the mean diameter 17 of the metal particles 16 of the second metal particle layer 52 at a middle location. The mean diameter 17 of the metal particles 16 of the second metal particle layer 52 at the middle location is smaller still than the mean diameter 17 of the metal particles 16 of the third metal particle layer 53 far away from the first surface 12. The metal particles 16 which have the larger mean diameter 17 could make the pores larger and further the water exhausted more easily, between the metal particles 16. As shown in FIG. 3, by overlaying the different metal particle layers 51-53 having the metal particles 16 in different mean diameters 17, the porous forming mold 11 can be constructed with the exquisite first surface 12 and a great water-exhausting performance.

It is understood that the shape of the respective metal particles 16 can be sphere shaped, irregular shaped, multilateral shaped, or other shapes. The sintered porous mold 11 can be performed by a variety of surface-fined machining operations, such as a conventional machining operation, laser cutting operations, computer numeral control (CNC)

machining operation, or electric arc operations, so as to make the mold surfaces smooth.

Because the porous metal mold 11 according to the preferred embodiment of the present invention is made by integrally sintering to have smooth surfaces, no assembly problem exist between the conventional mold and the mesh, no ungainly mesh-mark will be formed on the outer surfaces of the finished paper-shape product which is shaped without using of the mesh, and there is no seam appearing on the outer surfaces of the mold 11. It is hard to damage the mold 11 even during repeated times of matching compression so that the lifetime of the mold 11 can be maintained longer.

Figure 4A:
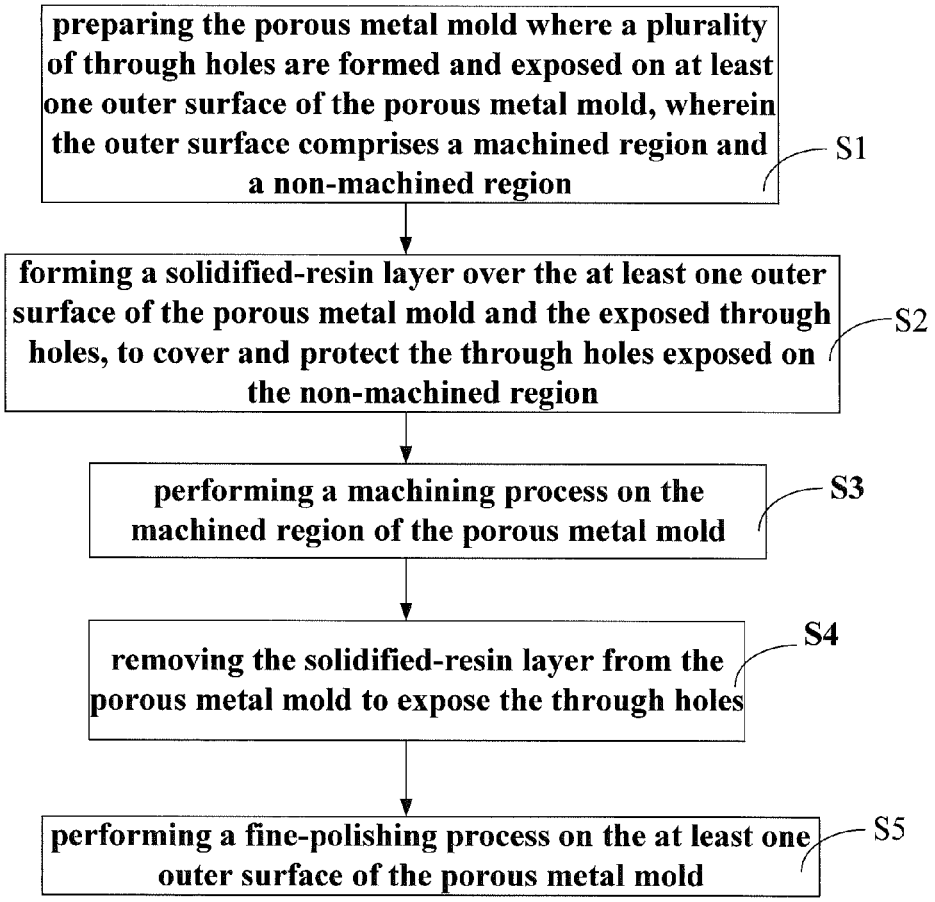
FIG. 4A is a flow diagram of a method of manufacturing a porous metal mold according to a third embodiment of the present invention.
Figure 4B:
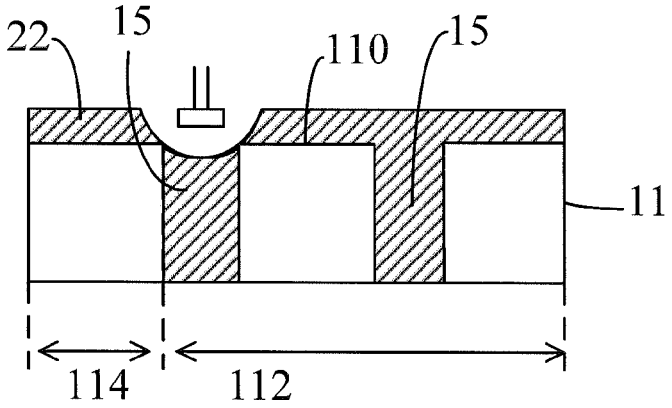
FIG. 4B is an illustrative view of a machining operation applied on the porous metal mold, according to the manufacturing method of FIG. 4A.

Please refer to FIG. 4A and FIG. 4B. FIG. 4A is a flow diagram of a method of manufacturing a porous metal mold (as the mold 11 mentioned above) for a wet pulp molding process, according to a third embodiment of the present invention. The manufacturing method comprises the following steps of: (S1) preparing the porous metal mold 11 where a plurality of through holes 15 are formed and exposed on at least one outer surface 110 of the porous metal mold 11, wherein the at least one outer surface 110 comprises a machined region 112 and a non-machined region 114; (S2) forming a solidified-resin layer 22 over the at least one outer surface 110 of the porous metal mold 11 and the through holes 15, so as to cover and protect the through holes 15 extended through and exposed on the non-machined region 112; (S3) performing a machining process to the machined region 112 of the porous metal mold 11; (S4) removing the solidified-resin layer 22 from the at least one outer surface 110 of the porous metal mold 11 to expose the through holes 15 outside the mold 11; and (S5) performing a fine-polishing machining process on the at least one outer surface 110 (including the machined region 112 and the non-machined region) of the porous metal mold 11.

Figure 5:
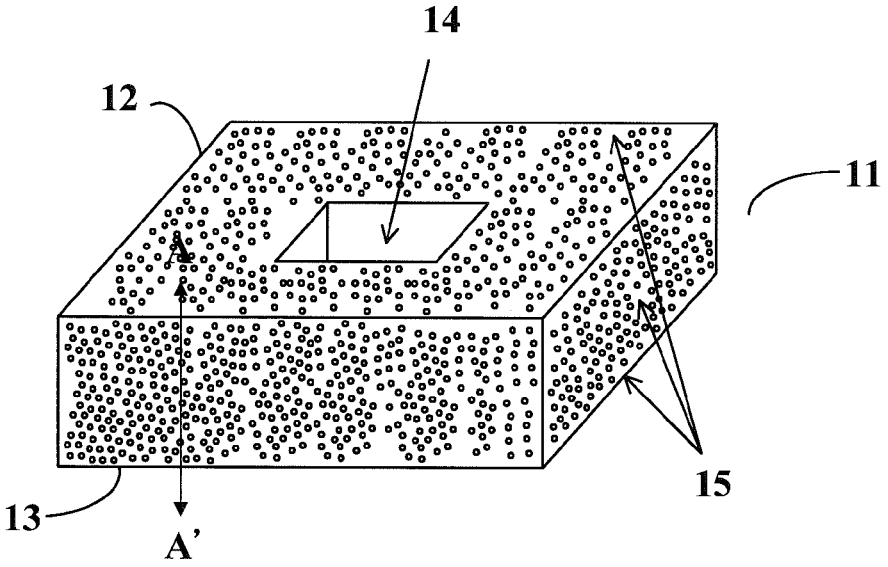
FIG. 5 is a stereoscopic illustrative view of the porous metal mold formed by the manufacturing method of FIG. 4A.
Figure 6:
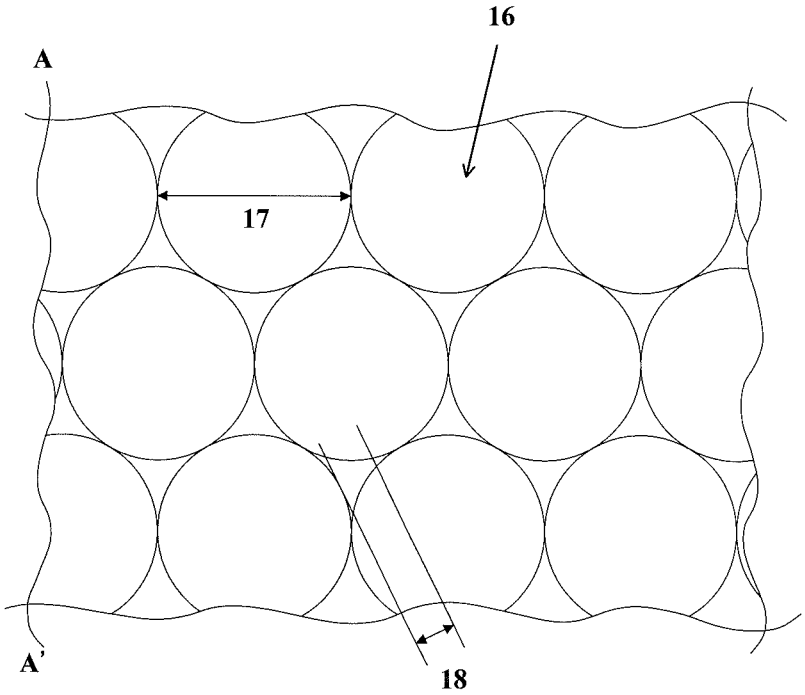
FIG. 6 is a sectional-enlarged illustrative view according to a line A-A' shown in FIG. 5.

As shown in FIG. 5 and FIG. 6, in one preferred embodiment of the present invention, the above step (S1) further comprises the steps of: (S1-1) choosing a plurality of metal particles 16 in a specific mean diameter range, according to a predetermined sintering pore-ratio; (S1-2) filling the metal particles 16 into a sintering mold with a specific shape (not shown); (S1-3) heating the metal particles 16 filled in the sintering mold to a specific sintering temperature, so as to derive the porous metal mold 11 with the predetermined sintering pore-ratio.

In the above step (S1-1), while choosing the metal particles 16 has to consider the properties including a particle shape, a fineness degree (as size of the metal particles 16), a particle size distribution, a flow-ability (as a condition of the particles flowing to and filled within the mold cavity), compressibility (as a volume ratio calculated by dividing a before-compressed volume by an after-compressed volume, for the same object), an apparent density (as a weight of each unit volume), a sintering property (as a temperature to integrate the metal particles with each other), and set forth. The more irregular the shape of the metal particles 16 is, the greater the strength of compressing the pulp is, the finer the particles is, and the larger the surface area is. The better sintering property is, and the better sintering property is. It means that the larger a useful temperature range is, and easier the sintering is.

As shown in FIG. 5 and FIG. 6, in one embodiment of the present invention, in order to easily sintering the metal porous mold 11 having the predetermined sintering pore-ratio (as a ratio of the pore 18 for every two metal particles in the whole metal porous mold 11), the specific mean diameter 17 of the metal particles 16 is set in a range of 2-20 μm, and the predetermined sintering pore-ratio of the sintered metal porous mold 11 is set between 10%-25% of the volume of the porous metal mold 11.

It is understood that, in order to increase the flow ability and the apparent density, a variety of other metal particles with different sizes can be mixed thereto, or lubricants can be added thereto thereby decreasing the stickiness among the metal particles 16, or decreasing the friction force of sidewalls of the mold 11 upon compression, so as to make the product easily separated from the mold 11.

Generally, in the step (S1-2), an in-mold compression-forming method is used wherein the metal particles 16 are positioned within a steel mold having a specific shape. Next, by a pressure between thousands pounds per square inches to two hundred thousand pounds per square inches, the compression-forming is performed inside the steel mold. Besides, the strength of the pressure depends on the features of the metal particles 16. For soft metal particles 16 with high plasticity, just a low pressure can make the metal particles 16 firmly integrated with each other; however, for crisp and high hard metal particles 16, a higher pressure is required.

Ideally, the metal particles 16 are chosen from copper, which mainly depends on the heat-conduction ratio of the metal particles 16. Furthermore, any material with the heat-conduction ratio larger than 50 W/mK can be chosen, such as stainless steel or nickel alloy. In the step (S1-3), a sintering time is between 30-60 minutes. The specific sintering temperature of copper is between 800° C.-920° C.; the specific sintering temperature of stainless steel or nickel alloy is between 1000° C.-1350° C.

Besides, the step (S1-2) and the step (S1-3) can be merged into a thermo-compressing method, which optionally performs the compression-forming and sintering steps of the metal particles 16 within the same casting mold at the same time.

In one embodiment of the present invention, the above step (S2) further comprises the following steps of: (S2-1) soaking the porous metal mold 11 in a solidifiable resin solution, so as to cover a resin layer on the at least one outer surface 110 of the porous metal mold 11 (including the exposed through holes), which avoids the through holes 15 of the non-machined region 114 of the at least one outer surface 110 of the mold 11 from being chocked or damaged by scraps generated during a machining operation applied on the machined region 112 for the next machining operation process of the metal porous mold 11; and (S2-2) performing a solidifying process to solidify the resin layer so as to form the solidified-resin layer 22 (as referring to FIG. 4B).

In the step (S2-1), the solidifiable resin solution is a solution of a thermoplastic resin or a light curable resin. In the embodiment, the thermoplastic resin or the light curable resin is at least one or a combination of melamine resin, urea-formaldehyde resin, and phenol-formaldehyde resin.

For one embodiment of the present invention, in the step (S2-2), the solidifying process is performed by heating or applying a light with a certain wavelength, such as ultra violet (UV).

Because the different metal particles 16 have different physical and chemical features, according to one embodiment of the present invention, in the step (S3) the machining process is at least one or a combination of a traditional cutting operation, a milling operation, a laser cutting operation, a computer numeral control (CNC) machining operation, or an electric arc operation. By the above various machining operations to machine the machined region 112 of the metal porous mold 11, a predetermined shape of the mold 11 can be made.

For one embodiment of the present invention, the step (S4) of removing the solidified-resin layer 22 from the at least one outer surface 110 of the porous metal mold 11 to expose the through holes 15 outside the mold 11 is implemented as that after the machining operation, the porous metal mold 11 where its surface may preserve the residua of the solidified-resin layer 22 is put in an oven with heating to a certain temperature, thereby burning out the residua of the solidified-resin layer 22, which is detached from the porous metal mold 11. The certain temperature means any temperature between the ignition point of the solidified-resin layer 22 and the melting point of the porous metal mold 11.

Because the solidified-resin layer 22 of the at least one outer surface 110 of the porous metal mold 11 is removed by burning. However, there is still some incompletely-burned residue of the solidified-resin layer 22 remaining on the at least one outer surface 110 of the porous metal mold 11; hence, in one embodiment of the present invention, the porous metal mold 11 can be processed by performing a fine-polishing process on the at least one outer surface 110 according to the step (S5), so as to derive the porous metal mold 11 with a great surface smoothness.

As shown in FIG. 5, because the porous metal mold 11 manufactured by the manufacturing method of the present invention is integrally made of the metal particles, the porous metal mold 11 comprises a first surface 12 and a second surface 13. The first surface 12 is formed with a plurality of exposed through holes 15 and a cavity which is used to dispose a paper-pulp-fiber layer so as to form a finished paper-shape product or a semi-finished paper-shape product. Principally, the cavity 14 is used to firmly shape the finished paper-shape product or the semi-finished paper-shape product. The plurality of exposed through holes 15 are also extended through the second surface 13 to connect with the corresponding pores among the metal particles 16 in multi-directions. In other words, a multi through passages are therefore built up between the first surface 12 and the second surface 13 of the mold 11, to exhaust the water or moisture in the paper-pulp-fiber layer. With the multi through passages formed inside the porous metal mold 11, no additional metal mesh is needed. Not only can the operation procedure of the mold 11 be simplified and mesh-marks caused by the metal mesh of conventional mold be eliminated, but also the smooth appearance can be achieved.

Besides, a wet pulp forming process according to a preferred embodiment of the present invention employs the porous metal mold manufactured by the method as above mentioned embodiments to perform the dredging step and/or compression-forming step.

Although the present invention has been disclosed as preferred embodiments, the scope of the claims of the present invention must be defined. The foregoing preferred embodiments are not intended to limit the present invention.

What is claimed is:

1. A wet paper porous metal mold for a wet pulp molding process, comprising:

a porous metal mold having a plurality of metal particles being in physical contact with each other;

a first surface configured to dispose where a paper-pulp-fiber layer on the first surface is disposed for forming a finished paper-shape product or a semi-finished paper-shape product;

a cavity formed on the first surface, the cavity having a defined shape, for shaping the finished paper-shape product or the semi-finished paper-shape product; and a second surface opposite to the first surface;

wherein the porous metal mold is made by integrally sintering a plurality of metal particles, and after the sintering at least one pore is formed between at least two of the metal particles;

so that at least one non-linear through hole is formed between formed in a void between each of the metal particles and extending between the first surface and the second surface of the porous metal mold, wherein the defined shape of the cavity and the voids between each of the metal particles are structured and configured such that water or, for exhausting water or moisture contained in the paper-pulp-fiber layer disposed on the first surface, under thermo-compression, is forced through the at least one non-linear through hole to be expelled, and wherein the defined shape of the cavity and the voids between each of the metal particles are structured and configured to generate negative pressure inside the cavity such that the expelled water is inhibited from flowing back through the at least one non-linear through hole.

2. The porous metal mold according to claim 1, wherein the metal particles are made of stainless steel, nickel-alloy, or copper.

3. The porous metal mold according to claim 1, wherein the metal particles are formed in sphere shapes, irregular shapes, multilateral shapes, or other shapes.

4. The porous metal mold according to claim 1, wherein a total pore-ratio of the porous metal mold is between 10%-25% of the porous metal mold.

5. The porous metal mold according to claim 1, wherein a heat-conduction ratio of the porous metal mold is larger than 50 W/mk.

6. The porous metal mold according to claim 1, wherein a mean diameter of the metal particles is in a range of 5-10 μm.

7. The porous metal mold according to claim 1, wherein at least one metal particle layer is formed between the first surface and the second surface.

8. The porous metal mold according to claim 7, wherein the at least one metal particle layer comprises a plurality of different metal particle layers, the metal particles respectively located in the different metal particle layers have different mean diameters.

9. The porous metal mold according to claim 8, wherein the mean diameter of the metal particles in which one of the metal particle layers is close to the first surface is smaller than the mean diameter of the metal particles in which one of the metal particle layers is far away from the first surface.

* * * * *